US005855277A

United States Patent [19]

Apps et al.

[11] Patent Number: 5,855,277

[45] Date of Patent: Jan. 5, 1999

[54] NESTABLE DISPLAY CRATE FOR BOTTLES WITH HANDLE FEATURE

[75] Inventors: William P. Apps, Alpharetta; Gerald R. Koefelda, Atlanta, both of Ga.

[73] Assignee: Rehrig Pacific Company, Inc., Los Angeles, Calif.

[21] Appl. No.: 888,585

[22] Filed: Jul. 7, 1997

Related U.S. Application Data

[63] Continuation of Ser. No. 423,347, Apr. 18, 1995, abandoned, which is a continuation-in-part of Ser. No. 268,997, Jun. 30, 1994, Pat. No. 5,465,843, which is a continuation-in-part of Ser. No. 18,317, Feb. 3, 1994, Pat. No. Des. 361,431.

[51] Int. Cl.[6] ..... B65D 21/04

[52] U.S. Cl. ..... 206/510; 206/506; 206/203; 206/427; 220/516; 220/513; 220/771

[58] Field of Search ..... 206/510, 506, 206/505, 507, 509, 511, 512, 427, 203, 563, 564, 821; 220/756, 771, DIG. 2, 513, 516, 519, 509

[56] References Cited

U.S. PATENT DOCUMENTS

| | | | |
|---|---|---|---|
| D. 224,366 | 7/1972 | Rehrig . | |
| D. 244,486 | 5/1977 | Johnson et al. . | |
| D. 247,648 | 3/1978 | Carroll et al. . | |
| 2,535,493 | 12/1950 | Gerber | 206/510 |
| 3,009,579 | 11/1961 | Ettlinger, Jr. . | |
| 3,052,373 | 9/1962 | Frater . | |
| 3,245,548 | 4/1966 | Kesilman et al. | 220/516 |
| 3,265,237 | 8/1966 | Pache et al. . | |
| 3,270,913 | 9/1966 | Bridenstine et al. . | |
| 3,332,574 | 7/1967 | Earp . | |
| 3,349,943 | 10/1967 | Box . | |
| 3,744,707 | 7/1973 | Ross . | |
| 3,794,208 | 2/1974 | Roush . | |
| 3,997,057 | 12/1976 | Craig . | |
| 4,095,720 | 6/1978 | Delbrouck et al. . | |
| 4,101,049 | 7/1978 | Wallace et al. . | |
| 4,105,117 | 8/1978 | Atkin et al. . | |
| 4,143,764 | 3/1979 | Moss, III . | |
| 4,256,224 | 3/1981 | Hirota . | |
| 4,319,685 | 3/1982 | David . | |
| 4,410,099 | 10/1983 | deLarosiere . | |

(List continued on next page.)

FOREIGN PATENT DOCUMENTS

| | | | |
|---|---|---|---|
| 231008 | 8/1987 | European Pat. Off. | 220/DIG. 2 |
| 1 351 218 | 3/1963 | France . | |
| 2698610 | 6/1994 | France | 206/506 |
| 28 01 077 | 7/1978 | Germany . | |
| 27 12 748 | 9/1978 | Germany . | |
| 725683 | 11/1966 | Italy . | |

*Primary Examiner*—Stephen J. Castellano
*Attorney, Agent, or Firm*—Banner & Witcoff Ltd.

[57] ABSTRACT

A low depth, nestable display crate for bottles, preferably of single serve capacity, is integrally molded from plastic and comprises two basic components—a floor and a wall structure extending up from the floor and extending around the periphery of the floor. The floor preferably has an open lattice design and includes container support areas. The bottom surface of the floor is configured for accommodating the tops of bottles in a similar crate underneath. The wall structure comprises a lower wall portion adjacent the floor and a plurality of integrally formed pylons arranged around the periphery of the crate. The pylons are hollow and tapered so that pylons of empty crates can nest within one another. Handles are integrally formed to extend between pylons on opposing walls to provide handle bars flush with the tops of the pylons. This configuration of the handles provides sufficient clearance for a user's hands to grasp the handle bars in either a palm-up or palm-down position to facilitate handling of the crate and alleviate hand and wrist fatigue and prevent injuries. The crate of the present invention combines the advantages of a nesting crate with sufficient strength afforded by its double-walled construction, ease of handling and maximum, unobstructed visibility of the bottles.

5 Claims, 6 Drawing Sheets

U.S. PATENT DOCUMENTS

| | | | |
|---|---|---|---|
| 4,759,451 | 7/1988 | Apps . | |
| 4,773,554 | 9/1988 | Warwick . | |
| 4,846,365 | 7/1989 | Steinlein | 206/510 |
| 4,899,874 | 2/1990 | Apps et al. . | |
| 4,928,841 | 5/1990 | Arthurs . | |
| 4,932,532 | 6/1990 | Apps et al. . | |
| 4,944,400 | 7/1990 | Van Onstein et al. . | |
| 4,978,002 | 12/1990 | Apps et al. . | |
| 5,060,819 | 10/1991 | Apps . | |
| 5,096,085 | 3/1992 | Eek et al. . | |
| 5,097,890 | 3/1992 | Nakao . | |
| 5,105,948 | 4/1992 | Morris et al. . | |
| 5,213,211 | 5/1993 | Umiker | 206/821 |
| 5,335,814 | 8/1994 | Hepp . | |
| 5,426,890 | 6/1995 | Dümmen . | |
| 5,465,843 | 11/1995 | Koefelda | 206/507 |
| 5,487,487 | 1/1996 | Hammett | 206/509 |

NESTABLE DISPLAY CRATE FOR BOTTLES WITH HANDLE FEATURE

CROSS-REFERENCE TO RELATED APPLICATION

This application is a continuation of application Ser. No. 08/423,347, filed Apr. 18, 1995, now abandoned, which is a continuation-in-part of patent application Ser. No. 08/268,997, filed Jun. 30, 1994, now U.S. Pat. No. 5,465,843, which is a continuation-in-part of design patent application Ser. No. 29/018,317, filed Feb. 3, 1994, now U.S. design Pat. No. D 361,431.

BACKGROUND OF THE INVENTION

The present invention relates to a nestable display crate for transporting and storing containers, more particularly, the present invention relates to crates or trays that combine nestability and high strength with high visibility for displaying bottles.

Bottles, particularly for soft drinks and other beverages, are often stored and transported during the distribution stages thereof in crates or trays. The term "crate" or "tray" as used herein includes crates, trays and similar containers having a bottom and peripheral sidewall structure. These crates generally are configured to be stacked on top of each other when loaded with bottles, and nested together when empty of bottles. The plastic crates provide advantages such as conservation of storage space and efficient, easy handling and recyclability. In order to minimize the storage space of the crates when nested and to reduce cost and weight, many crates today are made with a shallow peripheral sidewall structure. These generally are referred to as "low depth" crates in which the bottles bear most of the load of above-stacked crates. Crates having a higher peripheral sidewall, approximately the same height as the bottles generally are referred to as "full depth" crates in which the crates themselves bear most of the load of above-stacked crates.

Low depth crates are generally less expensive and lighter in weight than similarly constructed full depth crates. Thus, low depth crates are used extensively. Generally, low depth crates have been designed with a plurality of columns interconnecting a top band to a floor. An example of such a low depth tray for cans is disclosed in commonly assigned U.S. Pat. No. 5,184,748, the disclosure of which is hereby incorporated by reference in its entirety. The tray disclosed in the '748 patent is a nestable tray meaning that identical empty trays can be nested together to conserve retail or storage space.

Another example of a known low depth bottle crate for bottles of single serve capacity is disclosed in commonly assigned U.S. Pat. No. 5,060,819, the disclosure of which is also hereby incorporated by reference in its entirety. The bottle crate of the '819 patent has a sidewall structure with upright adjacent panels, alternating ones of which are raised such that their lower surfaces are spaced above the floor. The top and bottom edges of the sidewall thereby have an undulating configuration such that empty trays can nest together.

Single serve bottles are generally packed by bottlers in cases or other containers, several bottles to the case, for shipment to retailers or for storage. Cases of bottles are customarily stacked on top of each other. One way of handling the cases of bottles is to stack the cases on pallets which can be lifted and moved about by fork-lift trucks. A technique for interconnecting columns of cases, is called cross-stacking, and is often used to improve stability of a stack of cases, or for display purposes by the retailer. There has been a need for bottle cases having structural features which facilitate handling of stacked and cross-stacked loaded cases, enhances stability of stacked columns of such cases and provides maximum visibility of the bottles, especially in a retail setting.

One of the problems associated with previous nestable crates, particularly, those for single serve bottles, has been lack of strength when used in some settings. The tray of the '819 patent, for instance, has a sidewall which may not stand up to very rough handling over time. Accordingly there has been a need for reusable nestable crates having the requisite strength and rigidity to withstand repeated or rough handling.

Another problem experienced with previous nestable crates has been somewhat limited visibility of the bottle or container labels. Although the column and band trays, such as the one disclosed in the '748 patent, do allow for much of the labels to be displayed, the band obstructs the view of the containers to some degree. Similarly, the undulating sidewall of the '819 tray allows for some visibility. There has been a need for a nestable crate which has improved and structural strength and provides increased bottle or container visibility.

In many instances bottles having the same or similar capacity may have differently sized bottle tops. There has been a need for a single crate which can securely engage differently sized bottle tops in a similar crate therebeneath.

SUMMARY OF THE INVENTION

Accordingly, it is a principal object of the present invention to provide a low depth bottle crate which is nestable with other similar crates when empty to conserve space, and which is stackable and cross-stackable with other similar crates when loaded with bottles or containers for storing, displaying and transporting the containers. The crate of the present invention includes features for nesting empty crates and for stably stacking and cross-stacking loaded crates.

Another object of the present invention is to provide a low depth, nestable crate which has sufficient structural strength to withstand repeated and rough handling.

Another object of the present invention is to provide a sturdy low depth, nestable crate which also provides maximum visibility of the bottles or containers for display purposes.

Still another object of the present invention is to provide a low depth, nestable crate which makes efficient use of space both when loaded and stacked and when empty and nested. When loaded and stacked, the present invention also has structural features which securely engage the tops of variously sized bottle tops.

Directed to achieving these objects, a new low depth, nestable crate for bottles is herein provided. The preferred configuration is for single serve capacity bottles of sixteen or twenty ounce capacity. It will be understood that while the preferred embodiment of the present invention is configured for retaining bottles, the crate may be used to store or transport any type of container. This crate is formed by integrally molding from plastic, two basic components—a floor and a wall structure extending up from the floor and extending around the periphery of the floor.

The floor preferably has an open lattice design which not only allows unwanted fluids to drain out of the crate, but also requires less material and thus is lighter than a solid floor design. The floor also has container support areas, preferably in an array.

The floor of the crate has an outer or bottom surface which is configured for accommodating the tops of bottles in a similar crate underneath. The floor bottom surface preferably has upwardly recessed receiving areas disposed to receive the tops of bottles contained in a similar crate therebeneath. The receiving areas aid in retaining the bottles vertically upright which enhances the stability of stacked loaded crates. Directed to this feature, the receiving areas are each constructed to securely receive at least two different sizes of bottle tops. The receiving areas also prevent a crate from free-sliding along the tops of bottles in a crate underneath it. The peripheral surfaces of the receiving areas are beveled to allow the crate to disengage the tops of the bottles when the crate is rotated about a vertical axis so that once disengaged, the crate may slide along the tops of the bottles in the lower crate to facilitate handling.

The wall structure comprises a lower wall portion adjacent the floor and a plurality of integrally formed pylons arranged around the periphery of the floor of the crate. It will be understood that "pylon" denotes the upwardly extending hollow columns or posts. The lower wall portion is of double-walled construction since the hollow pylons naturally lend themselves to being integrally formed with such a double-walled lower portion. The hollow pylons are preferably angled toward the interior of the crate and tapered to be smaller in cross section at the top and larger near the lower wall portion so as to allow pylons of empty crates to nest within one another.

The pylons are preferably arranged along opposing sidewalls of the crate and each pylon is positioned between adjacent support areas of the floor so that in profile, the sidewalls of the crate have a sawtooth-like appearance as shown in FIG. 1. A pylon is positioned at each corner. The bottles loaded in the crate are visible through the open spaces between the pylons. The endwalls of the crate comprise integrally molded handles which are configured to allow for palm-up or palm-down gripping. The crate of the present invention combines the advantages of a nesting crate with sufficient strength afforded by its double-walled construction with maximum, unobstructed visibility of the bottles.

These and other features and advantages of the invention may be more completely understood from the following detailed description of the preferred embodiments of the invention with reference to the accompanying drawings.

DETAILED DESCRIPTION OF THE PREFERRED EMBODIMENTS

The present invention is a low depth crate which has structural features to afford sufficient strength, facilitate nesting of empty crates and stable stacking and cross-stacking of loaded crates, and provide maximum visibility to the bottles or containers. The present invention is especially adaptable for single serve capacity bottles, either glass or plastic.

Figure 1:
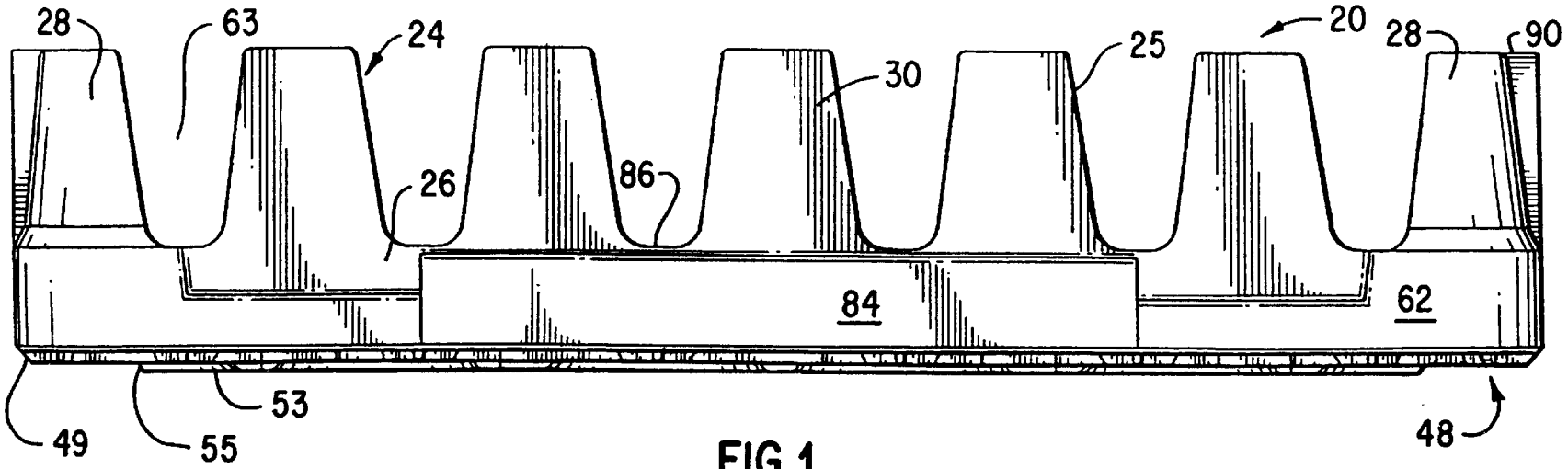
FIG. 1 is a side elevational view of a sidewall of the crate in accordance with the preferred embodiment of the present invention.
Figure 2:
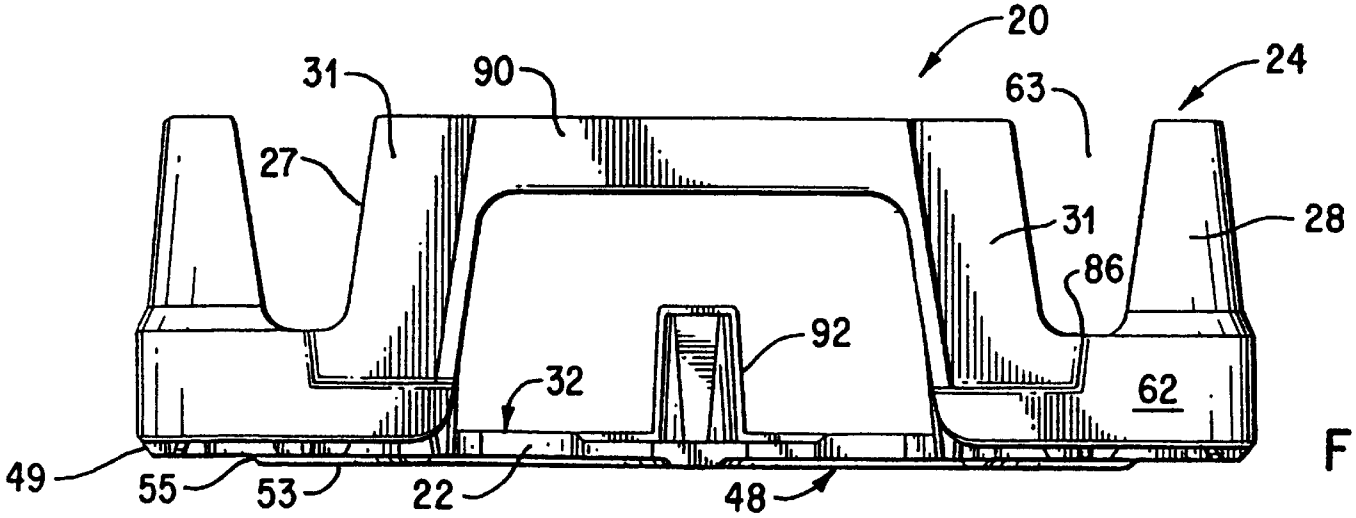
FIG. 2 is an end elevational view of the endwall of the crate of FIG. 1.

Referring to FIGS. 1 and 2, the crate 20 comprises two basic elements, a floor 22 and a wall structure 24. The wall structure that defines the periphery of crate 20 comprises a lower wall portion 26 and a plurality of pylons including corner pylons 28 and side pylons 30 and pylons 31. Crate 20 is preferably rectangular and the wall structure comprises sidewalls 25 and endwalls 27. Although a rectangular crate is shown and described, the present invention is not limited thereto and may comprise sidewalls and endwalls of equal length resulting in a square crate.

Figure 3:
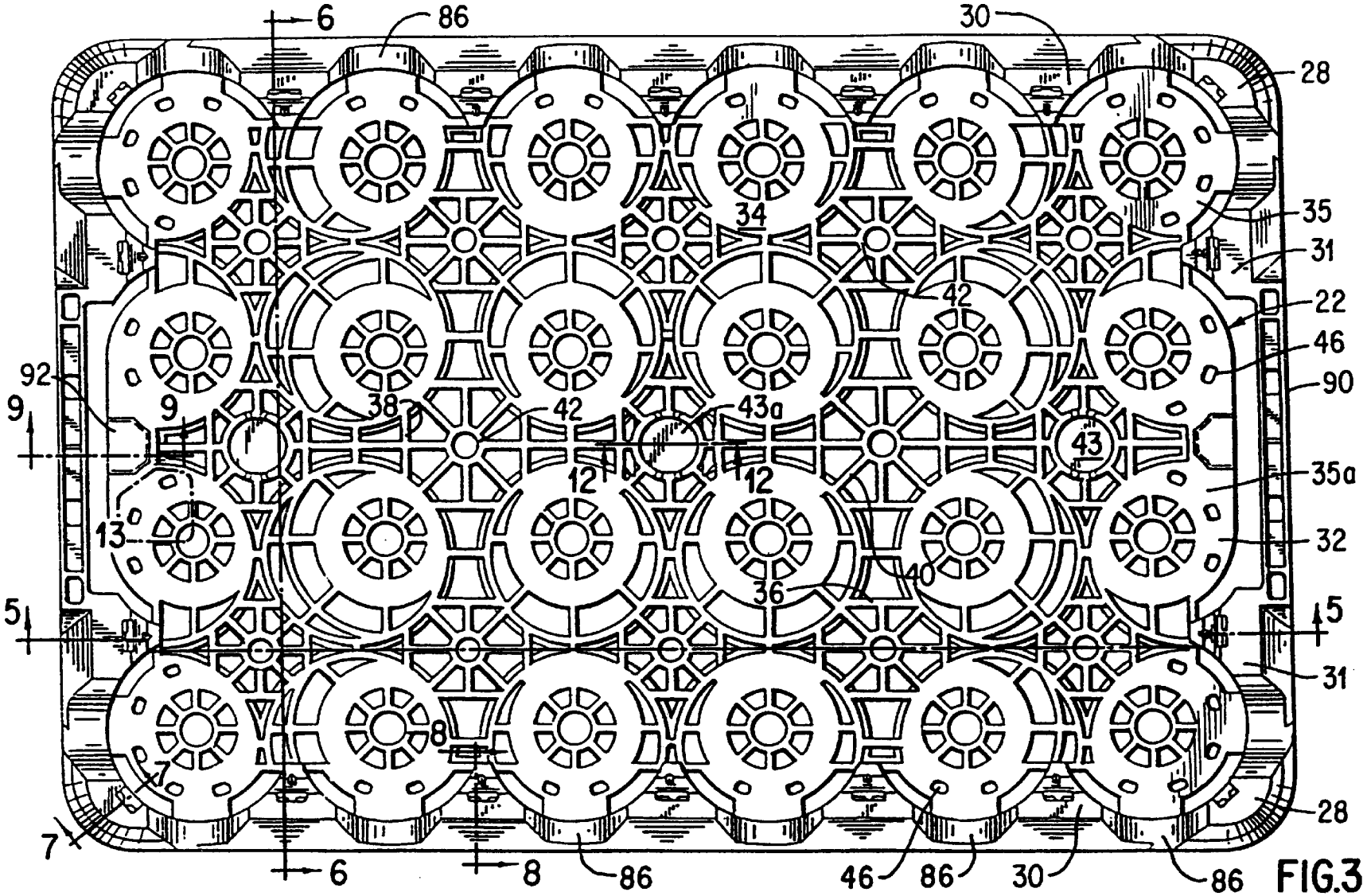
FIG. 3 is a top plan view of the crate of FIG. 1.
Figure 4:
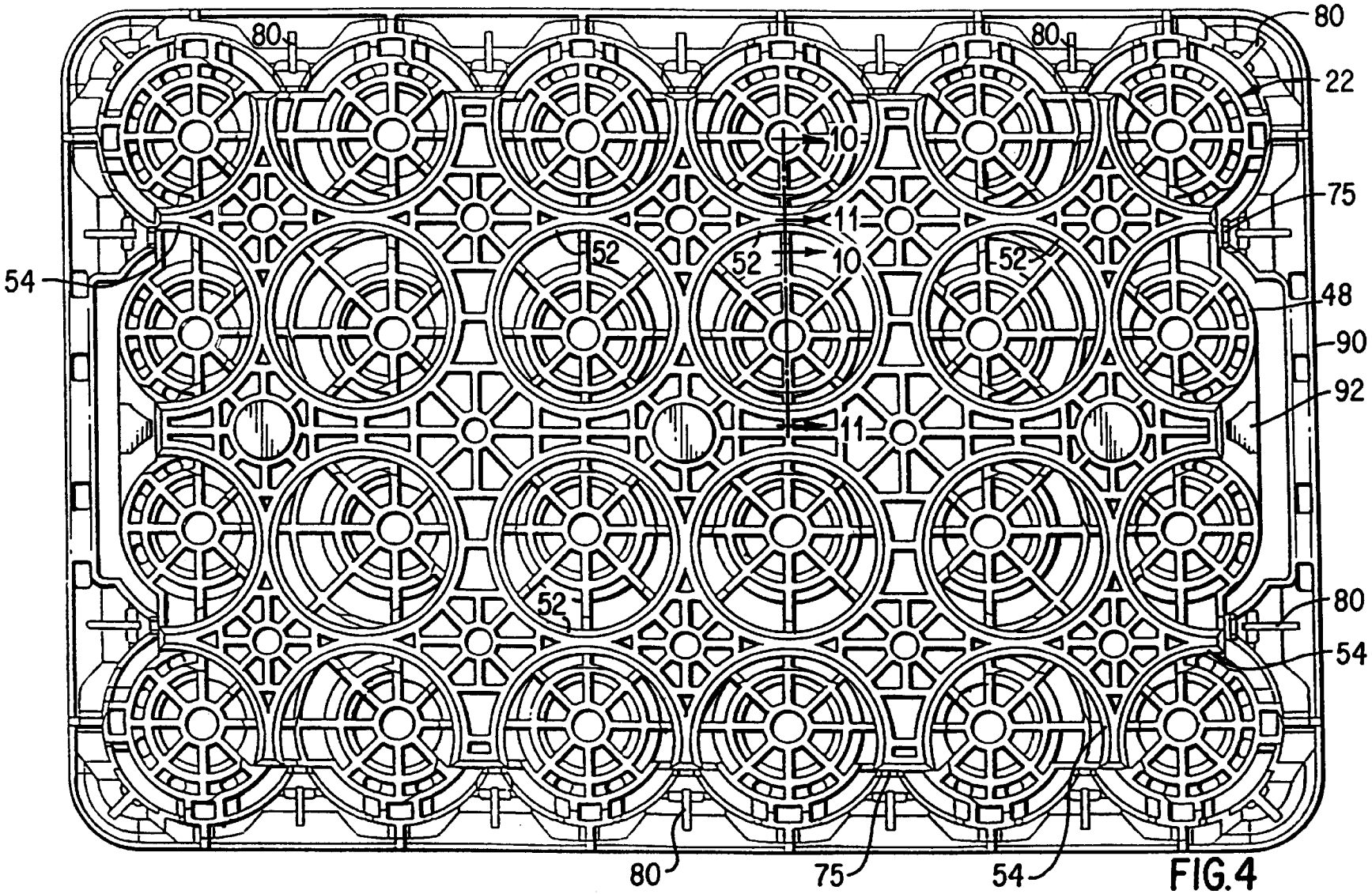
FIG. 4 is a bottom plan view of the crate of FIG. 1.

Floor 22 preferably has a lattice-like configuration having a pattern of open spaces as seen in FIGS. 3 and 4, which illustrate the top and bottom views of the floor respectively. The open floor design provides a light weight crate, and is practical for allowing any liquids to drain through floor 22. The floor is generally flat and open so as not to interfere with secondary wraps or binding means around multi-packs of bottles such as plastic wrap.

Figure 12:
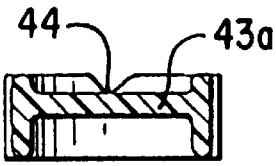
FIG. 12 is a cross section of the crate taken along line 12—12 of FIG. 3.

Referring to FIGS. 1–4, floor 22 has an upper or top surface 32 which is generally flat and includes a plurality of preferably circular support areas or rings 34 for supporting bottles thereon. Arranged at the corners of crate 20 are corner support areas 35 which are similar to support areas 34 in most respects, and will be described in detail herebelow. Arranged along the endwalls are endwall support areas 35*a* which also are similar to support areas 34 and will be described in detail herebelow. Support areas 34, 35 and 35*a* are connected to each other by a system of grid-like longitudinal struts 36 and lateral struts 38 traversing floor 34 in perpendicular relation to one another, and diagonal struts 40 extending preferably radially from support areas 34. Interstitial lattice members 42 are preferably circular elements located between support areas 34 and 35 and are integrally formed with the longitudinal, lateral and diagonal struts. Perpendicular struts 36 and 38 extend generally the full length and width of floor 22, and connect the rows and columns of support areas 34, 35 and 35*a*. Some perpendicular struts 36 and 38 are joined radially to circular lattice members 42. Diagonal struts 40 radially connect lattice members 42 and support areas 34, 35 and 35*a*. Lattice members 42 are preferably in uniform size except for three larger circular lattice members 43 located along the longitudinal axis of the crate from endwall to endwall. The central lattice member 43*a* is shown in cross section in FIG. 12, and is the preferred location of injection point 44 for injection molding crate 20.

The support areas are arranged in rows and columns to thereby define one or more arrays. In one of the preferred embodiments, a four by six array accommodates twenty-four sixteen or twenty-ounce bottles. In other embodiments, one liter bottles may be arranged in a three by four array of twelve or in a three by five array of fifteen. The support areas are configured so that bottles in an array are retained in relatively close relation so as to prevent jostling of the bottles during handling. Excess movement of the bottles is to be avoided in order to ensure that the bottles remain in a vertically upright position to most advantageously bear the load of bottles stacked or cross-stacked thereabove.

Figure 13:
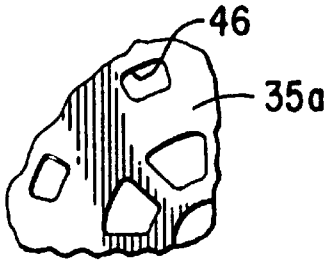
FIG. 13 is an enlarged, detailed view of area 13 shown in FIG. 3.

Each support area or ring 34, 35, 35*a* is sized to seat bottles and is connected to the other support areas by perpendicular struts 36, 38 and diagonal struts 40. Support areas 34, 35 and 35*a* preferably have solid, generally flat surfaces with the support areas around the periphery of the crate having drain holes 46. FIG. 13 illustrates a detailed view of a portion of an endwall support area 35*a*, the area marked in FIG. 3.

Floor 22 has a bottom surface 48 which has distinctive structural features. Floor bottom surface 48 is configured to allow for stacking and cross-stacking of loaded crates. Cross-stacking is done by rotating a top crate 90 degrees about a vertical axis and lowering onto a bottom crate or crates. During shipping and handling crates may be moved by machines and it is advantageous to use crates which can be stably stacked or cross-stacked. Additionally, when the crates are used to display the containers in a retail setting, the retailer may wish to cross-stack the crates for display or space reasons.

Figure 10:
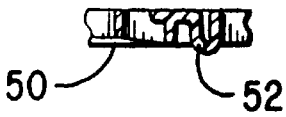
FIG. 10 is a cross section of the crate taken along line 10—10 of FIG. 4.
Figure 11:
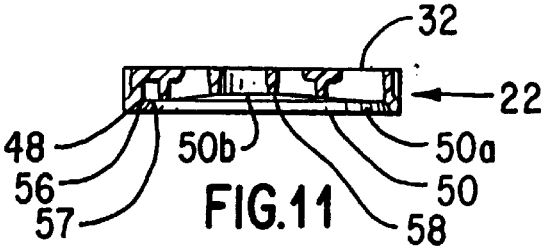
FIG. 11 is a cross section of the crate taken along line 11—11 of FIG. 4.

Floor bottom surface 48 has a plurality of upwardly recessed bottle top receiving areas 50, best shown in FIG. 11. The peripheries of the recessed receiving areas 50 are defined by circles 52 and arcs 54 which are integrally molded with and form part of floor bottom surface 48. The positions of circles 52 and arcs 54 are determined to provide a range within which the bottle tops in a loaded crate therebeneath may reside and still provide safe stacking and cross-stacking. Receiving areas 50 help retain bottles in vertically upright positions to bear the load of bottles stacked or cross-stacked thereabove. In general, peripheral receiving areas 50, that is, those adjacent to the wall structure defined by arcs 54, and the central receiving areas are defined by circles 52. Receiving areas 50 which are centrally located on the floor bottom surface are less offset from their corresponding support areas 34 than those nearer the wall structure. A detailed cross section of a portion of a circle 52 is shown in FIG. 10.

The peripheral surfaces of receiving areas 50 are beveled surfaces 56. In the stacked or cross-stacked positions, the receiving areas prevent a crate from sliding freely along the bottle tops in a lower crate, once the receiving areas are disengaged from their retaining positions, that is the stacked or cross-stacked positions, the upper crate may slide along the bottles tops in the lower crate to facilitate handling. Bevel 56 allows crate 20 to ride up onto the bottle tops in a lower crate when the upper crate is rotated slightly about a vertical axis.

A detailed view of receiving area 50 in FIG. 11 illustrates that it is more than a simple indentation. Receiving area 50 is constructed to accommodate more than one size of bottle tops. There are actually two concentric receiving zones: the outer zone 50*a* and the inner zone 50*b*. In the preferred embodiment, outer zone 50*a* is defined by the beveled surface 56 around the periphery of the receiving area 50, and can accommodate a bottle top having a 38 mm diameter. The area immediately inside of bevel 56 is preferably a flat area 57, and in the first preferred embodiment is approximately 5 mm wide. Inner zone 50*b* is preferably defined by a spherical surface 58 whose edge is concentric to the bevel 56. Spherical surface 58 is further recessed upward than receiving area 50, and in the first preferred embodiment, snugly engages a bottle top having a 28 mm diameter. The edge of spherical surface 58 may facilitate disengaging the bottle tops therebeneath for sliding the crate along the bottle tops. For the other preferred embodiments it will be understood that while the dimensions may vary, the inner and other receiving zones are constructed as described above, appropriately proportioned for the particular crate.

Crate 20 of the present invention holds a relatively closely packed arrangement of bottles, and the crate may be slid along the bottle tops. This is due to the closely packed arrangement of bottles which tend to be more vertically stable.

Wall structure 24 defines the periphery of crate 20 with opposing sidewalls 25 and opposing end walls 27. Wall structure 24 has a lower wall portion 26, the interior 60, of which is integral with floor 22. The corners of crate 20 are rounded and integral with lower wall portion 26. A corner pylon 28 is formed in each corner 20. In addition to the corner pylons, arranged along sidewalls 25 are a plurality of side pylons 30 and along endwalls 27 are end pylons 31. All pylons 28 and 30 and 31 are integrally formed with lower wall portion 26 and with the floor. Pylons 28, 30 and 31 are preferably hollow, and extend upward from the floor and beyond the top surface of lower wall portion 26. In order to allow for nesting of empty crates, pylons 28 and 30 and 31 are preferably angled toward the interior of the crate, and tapered so that their cross sections at their tops are smaller than their cross sections nearer the lower wall portion.

Endwalls 27 of crate 20 comprise handles 90 which are integrally molded to extend from one end pylon 31 to the other. Handles 90 are flush with the tops of pylons 31. The length of handle 90 preferably spans two container support areas along the endwall.

In handling a loaded crate, the palm-up position refers to the position of a user's hands when the fingers are inserted below the handle bar 90 from the outside such that the palms generally face up and inward. The palm-down position refers to the position of a user's hands when the fingers are inserted below handle bars 90 from the inside of the crate such that the backs of the hands are facing each other and the palms are generally facing down and/or outward. The height of handles 90 and their length, two container support areas, ensures that a user's hands have sufficient clearance to grasp the handle in either the palm-up or palm-down positions. Providing a user with the option of handling the crate in either hand position helps alleviate fatigue and prevent hand-wrist injuries since a natural grasping motion can be used. The importance of this feature can be appreciated when the crate is loaded with bottles. The handles on prior crates or trays may have been too constricting on some user's hands, and may have required awkward and harmful hand/wrist positions, particularly when lifting and handling heavy loaded crates.

In order to ensure that the containers located on the endwall support areas are securely supported, a relatively short endwall column 92 is arranged underneath handle 90 between endwall support areas. Endwall column 92 is integrally mold with floor 22 and is preferably shaped to extend somewhat between the adjacent bottles on the endwall support areas.

Figure 5:
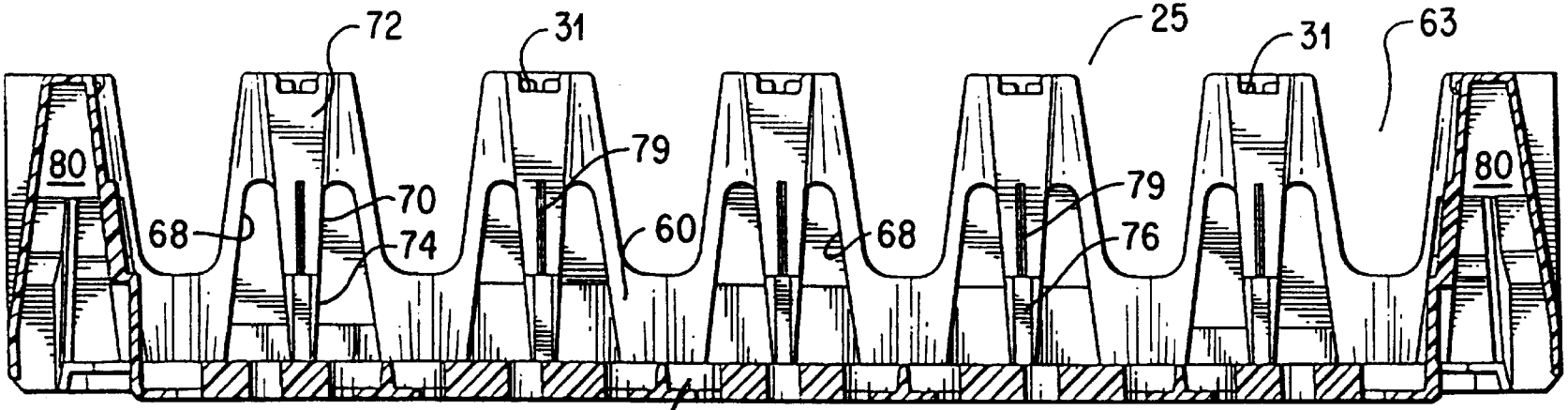
FIG. 5 is a cross sectional view of the crate taken along line 5—5 of FIG. 3.
Figure 6:
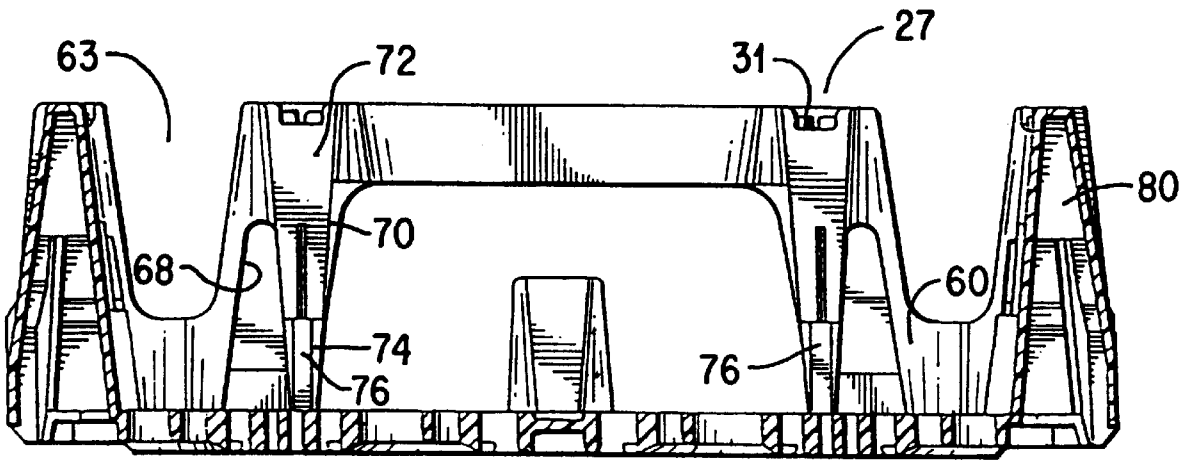
FIG. 6 is a cross sectional view of the crate taken along line 6—6 of FIG. 3.
Figure 7:
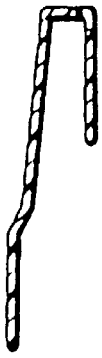
FIG. 7 is a cross section of the crate taken along line 7—7 of FIG. 3.
Figure 8:
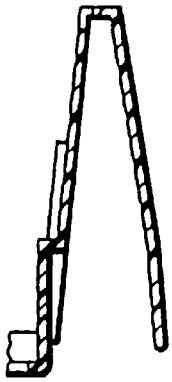
FIG. 8 is a cross section of the crate taken along line 8—8 of FIG. 3.
Figure 9:
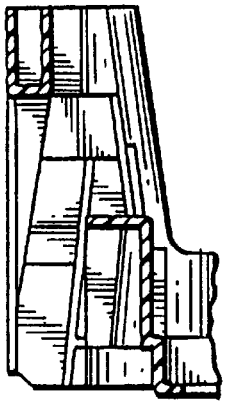
FIG. 9 is a cross section of the crate taken along line 9—9 of FIG. 3.

As shown in FIGS. 5 and 6, and cross section FIGS. 7–9, pylons 28 and 30 and 31 are integral with the interior lower wall portion 60 and also with exterior lower wall portion 62. Interior lower wall portion or panel 60 and exterior lower wall portion or panel 62 combine to provide a double-walled construction to crate 20 such that they are respectively contiguous with the interior and exterior surfaces of the pylons. The tops 86 of lower wall portions smoothly connect interior lower wall portion 60 to exterior lower wall portion 62. This construction ensures that crate 20 will have sufficient strength and rigidity for a variety of handling situations.

Crate profile views, FIGS. 1, 2, 5 and 6, show that exterior lower wall portion 62 is preferably not quite flush with floor bottom surface 48, such that floor bottom surface 48 is left exposed somewhat in profile. Leaving exterior lower wall portion 62 slightly higher than floor bottom surface 48 facilitates handling by allowing hand trucks to slide easily under the crate, and prevents the exterior lower wall portion from catching on bottle tops when the crate is being slid along the bottle tops as described above. The periphery of floor bottom surface 48 is finished with a beveled edge 49. In addition, the bottom surfaces of circles 52 and arcs 54 are the lowermost surfaces of the floor bottom 48. These are collectively labeled as bottom surface 53 in FIGS. 1, 2 and 4–6. The edges of bottom surface 53 are also finished with beveled surfaces 55. Therefore, when crate 20 rests on a flat surface, bottom surface 53 is in contact with the flat surface. Bevels 49 and 55 facilitate handling of the crate.

As best seen in FIG. 4, lower wall portion 26 also has an open bottom so that empty crates can be nested together.

Many of the advantages of the present invention relate to the nestability of the crates. An appreciation of the structural features which permit and facilitate nesting can be had with reference to FIGS. 5, 6 and 15. When empty crates 20 and 20' are nested, pylons 28 and 30 and 31 of upper crate 20 nest onto or above corresponding pylons 28' and 30' and 31' of lower crate 20' such that pylons 28' and 30' and 31', in effect, travel upward inside of pylons 28 and 30 and 31 respectively.

Side pylons 30 and 31 are arranged between adjacent support areas 34 (or 35 as the case may be) and define spaces or windows 63 therebetween. In this manner, when crate 20 is loaded with bottles which are seated on support areas 34 and 35, the sides of the bottles are visible through windows 63 for attractive displays, especially in a retail setting.

Figure 14:
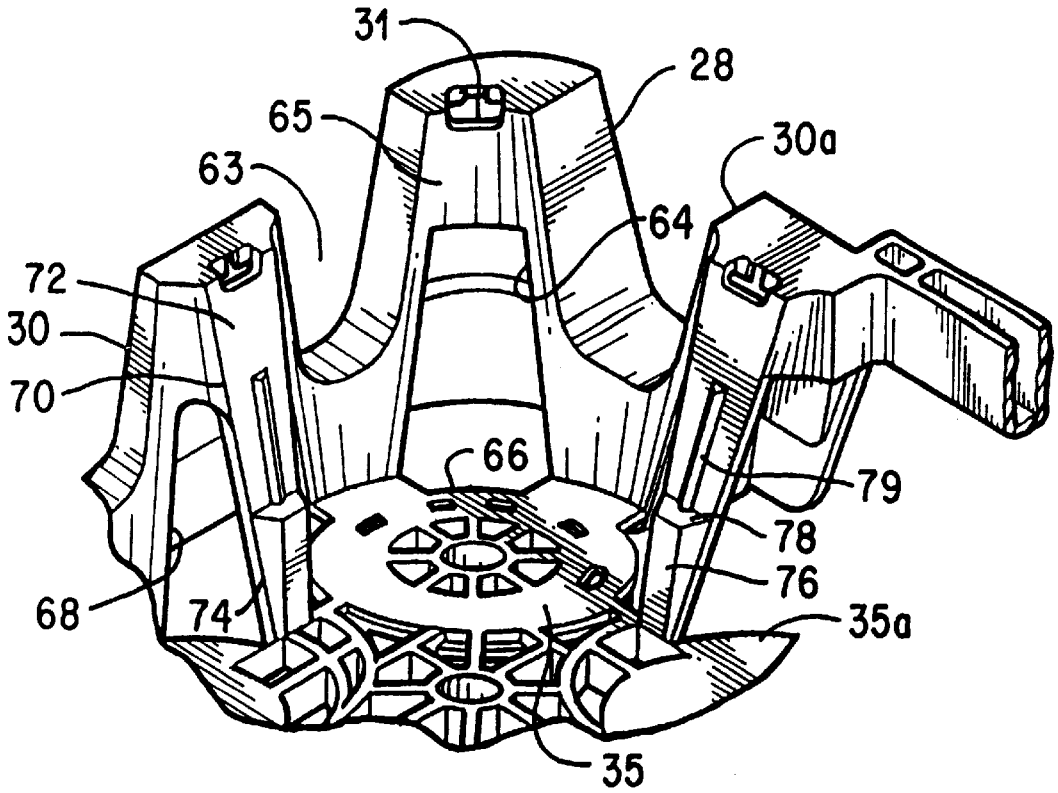
FIG. 14 is a detailed cut-away perspective view of a corner area of the crate of FIG. 1.

Corner pylons 28 preferably have apertures 64 disposed on the interior surface thereof to allow sufficient clearance for below-nested corner pylons to nest or travel into. As best seen in FIG. 14, aperture 64 in corner pylon 28 extends to floor 22 where corner support area 35 is also configured with a cut-away 66 so as to clear a below-nested corner pylon. The upper interior portions of corner pylons 28 include corner panels 65 which extend down from the tops of the corner pylons to apertures 64. Central panels 70 define bottom surfaces 75, best seen in FIG. 4. Slots 31 are provided at the juncture between the top of pylons 28 and corner panels 65.

Similarly, side pylons 30 and 31 are also configured to allow sufficient clearance for below-nested side pylons to nest into. The interior sides of side pylons 30 and 31 also have apertures 68, but instead of being left open, an integral central panel 70 having upper panel portion 72 and lower panel portion 74 extends down to floor 22. Central panels 70 are preferably angled outwardly from the floor toward the top of the pylons, and connect the pylons to the floor. In this way, central panels 70 will extend somewhat between adjacent bottles when crate 20 is loaded with bottles. Slots 31 are also provided at the juncture between the top of pylons 30 and 31 and upper panel portions 72.

Figure 15:
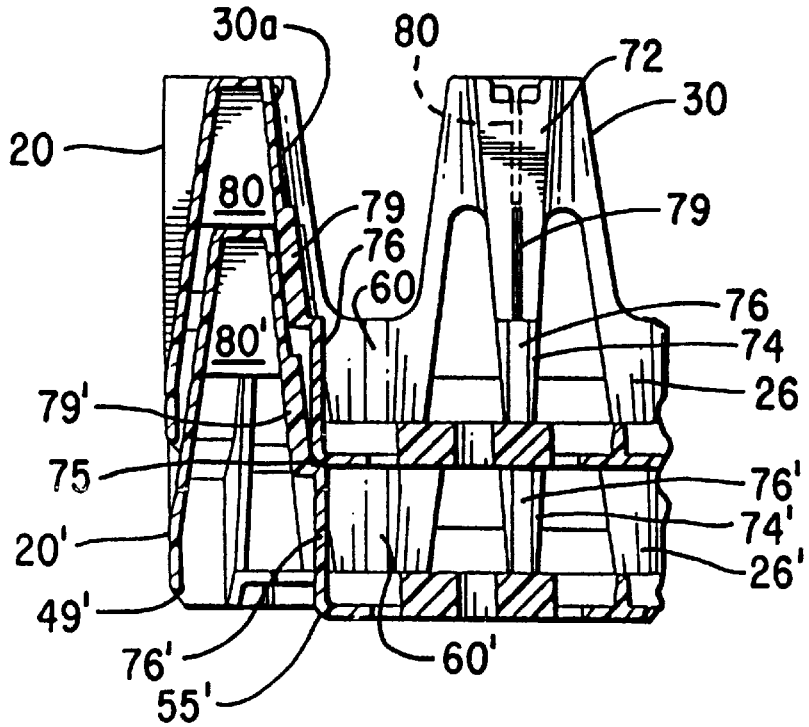
FIG. 15 is a fragmented cross sectional view similar to FIG. 5 if the crate of FIG. 1 nested with an identical empty crate.

In order to control the extent of travel inside of the pylons, at least two types of positive "stops" are preferably provided. The stops are provided to prevent nested crates from becoming wedged together, and to prevent any damage or deformation to the pylons or wall structure from repeated nesting and bearing the weight of above-nested crates. The first stop is inside the hollow pylons and the second stop is on the outside of the pylons. The outside the pylon stops 76 are integrally formed boxed-in structures on the lower panel portions 74 of side pylons 30 and 31. Stops 76 extend vertically upward from floor 22, and the top ledges 78 of the stop act as bearing surfaces for panel bottom surfaces 75 when crates 20 and 20' are nested. Although any number of panel bottom surfaces 75 could conceivably rest on ledges 78' of a tray nested below, in the preferred embodiment, contact is made at the four side pylons located on sidewalls 25 directly adjacent corner pylons 28. For example, as seen in FIG. 15, panel bottom surface 75 of the upper crate 20 is disposed slightly above ledge 78' of stop 76' of the lower crate 20' when the two crates are nested. Besides acting as positive stops for nesting, stops 76 also enhance the strength of central panel 70 which connects the pylons to the floor. Stops 76 are preferably provided on all side pylons 30 and 31, but the present invention is not limited to this configuration and stops 76 may be formed on fewer pylons. In conjunction with stops 76 are ribs 79 which extend upward from top edges 78 and are integral with central panels 70. Ribs 79 help strengthen the central panels of the pylons.

The inside the pylon stops or bridging ribs 80 are integrally formed in the hollow spaces inside pylons 28, 30 and 31. Bridging ribs 80 are best seen in FIGS. 5, 6 and 15 in cross section, and an exemplary bridging rib 80 has been drawn in phantom line on crate 20 of FIG. 15. Ribs 80 preferably are located in the upper part of pylons 28, 30 and 31, and hidden from view by corner panels 65 of corner pylons 28 and upper panel portions 72 of side pylons 30 and 31. FIG. 4 best illustrates how ribs 80 preferably span the inside of pylons 28, 30 and 31, bridging their interior and exterior surfaces. When crates are nested, ribs 80 bear against the tops of pylons 28, 30 and 31. Referring to FIG. 15, ribs 80 of crate 20 rest on the tops of pylons 28' and 30' and 31' of lower crate 20'.

An additional feature of the present invention is the provision of a flat label section 84 formed as part of exterior lower wall portion 62 for molding in logos, advertisements or the like.

The crate of the present invention combines the features of nestability, strength and visibility. In constructing the crate, many design parameters must be determined with the goal of enhancing the above mentioned characteristics without unduly sacrificing any of them. Visibility is important both for permitting attractive display but also for ensuring that UPC labels on the sides of the bottles may be read or scanned through windows 63 without having to remove the bottles. Increasing visibility of the bottles, that is, enlarging windows 63 between the pylons means decreasing the size of the pylons which results in an overall reduction in strength. In addition, large windows increases the chance of bottles hopping out of the crate through the windows. The present invention provides maximum visibility for its size without sacrificing strength and nestability.

From the foregoing detailed description, it will be evident that there are a number of changes, adaptations, and modifications of the present invention which come within the province of those skilled in the art. However, it is intended that all such variations not departing from the spirit of the invention be considered as within the scope thereof as limited solely only by the claims appended hereto.

We claim:

1. A crate for containers, the crate having a floor and a wall structure integral with the floor, the floor having a floor top surface and floor bottom surface, the floor top surface having thereon a plurality of support areas for supporting an array of containers, the wall structure integral with the floor and extending around the periphery thereof, said wall structure comprising opposing sidewalls and endwalls, comprising:

a lower wall portion adjacent and integral with the floor, wherein said lower wall portion is of double-walled construction and includes an interior lower wall portion and an exterior lower wall portion;

a plurality of tapered pylons extending up from the floor and beyond the top of said lower wall portion, said pylons spaced along the periphery of the floor and defining spaces therebetween through which containers loaded in said crate are visible, wherein the interior surfaces of said pylons are integral with said interior lower wall portion and the exterior surfaces of said pylons are integral with said exterior lower wall portion, and wherein said pylons are angled toward the inside of said crate, and hollow through at least a lower portion thereof so as to allow said pylons to nest onto corresponding pylons in a similar empty crate therebeneath, said pylons further comprising corner pylons disposed at the corners of said crate, and end pylons disposed along the endwall of said crate;

a handle structure integrally formed with and extending between adjacent ones of said end pylons, said handle structure extending over more than one support area on each of the endwalls of said crate, the top of said handle structure being flush with the tops of the end pylons in order to provide sufficient clearance for a user's hands to comfortably grasp said handle structure.

2. The crate of claim 1, further comprising an endwall column arranged underneath each of said handle structures between said adjacent endwall support areas to ensure that the containers on said endwalls support areas are maintained in the upright position.

3. In a crate for containers, the crate having a floor and a wall structure integral with the floor, the floor having a floor top surface and floor bottom surface, the floor top surface having thereon a plurality of support areas for supporting an array of containers, the wall structure integral with the floor and extending around the periphery thereof and comprising opposing sidewalls and endwalls, the improvement comprising:

a plurality of tapered pylons extending up from the floor, such pylons comprising side pylons spaced along the sidewalls of said crate and positioned between adjacent support areas, said side pylons defining spaces therebetween through which containers loaded in said crate are visible, said pylons further comprising corner pylons disposed at the corners of said crates, and end pylons disposed along the endwall of said crates;

a lower wall portion adjacent to an integral with the floor, wherein said lower wall portion is of double-walled construction and includes an interior lower wall portion and an exterior lower wall portion connected by a top surface, said lower wall portion extending between side pylons along the side walls of said crate; and a handle structure integrally formed on each of the end wall of said crate, said handle structure extending across at least one support area and integrally molded with two adjacent end pylons of said crate, said handle structure having interior and exterior surfaces suspended between an upper portion of said two adjacent end pylons, a generally open area being defined below said interior and exterior surfaces of said handle structure and wherein the top surface of said handle structure is flush with the top surfaces of said two adjacent end pylons to provide sufficient clearance for a user's hands to comfortably and freely grasp said handle structure about the entire periphery thereof.

4. The crate of claim 3, further comprising an endwall column arranged underneath each of said handle structures between said adjacent endwall support areas to ensure that the containers on said endwalls support areas are maintained in the upright position.

5. The crate of claim 3, wherein said corner pylons include a corner aperture and said side pylons each include a nesting aperture and central panel extending down from the top of said side pylons to be integral with the floor, said central panel bisecting said nesting aperture wherein said corner apertures and said nesting apertures provide sufficient clearance for said pylons to nestingly receive corresponding pylons of a similar crate nested therebeneath.

* * * * *